US006591772B1

(12) United States Patent
Larsen et al.

(10) Patent No.: US 6,591,772 B1
(45) Date of Patent: Jul. 15, 2003

(54) SLIDABLE AND IMPACT ABSORBING KEEL

(76) Inventors: Per Kristian Larsen, Furubakken 20, N-1395 Hvalstad (NO); Nils Otto Holmen, Landøyveien 117, N-1394 Nesbru (NO)

( * ) Notice: Subject to any disclaimer, the term of this patent is extended or adjusted under 35 U.S.C. 154(b) by 0 days.

(21) Appl. No.: 09/979,914

(22) PCT Filed: May 25, 2000

(86) PCT No.: PCT/NO00/00172

§ 371 (c)(1),
(2), (4) Date: Nov. 26, 2001

(87) PCT Pub. No.: WO00/73130

PCT Pub. Date: Dec. 7, 2000

(30) Foreign Application Priority Data

May 26, 1999 (NO) ..... 19992516

(51) Int. Cl.[7] ..... B63H 25/00
(52) U.S. Cl. ..... 114/140
(58) Field of Search ..... 114/140, 149; 441/79

(56) References Cited

U.S. PATENT DOCUMENTS 1,730,844 A 10/1929 Dupuis ..... 114/140
3,585,663 A * 6/1971 Johnson ..... 114/140
4,421,492 A * 12/1983 Leva ..... 114/140
4,538,539 A * 9/1985 Martin ..... 114/140
4,570,563 A * 2/1986 Stenlund ..... 114/140
5,351,638 A * 10/1994 Helleberg ..... 114/140

FOREIGN PATENT DOCUMENTS

| | | |
|---|---|---|
| DE | 3722259 A1 | 1/1989 |
| DE | 19604966 A1 | 8/1997 |
| SE | 444 296 | 4/1986 |

* cited by examiner

*Primary Examiner*—S. Joseph Morano
*Assistant Examiner*—Lars A. Olson
(74) *Attorney, Agent, or Firm*—Knobbe, Martens, Olson, and Bear, LLP

(57) ABSTRACT

A slidable, impact absorbing keel device for sailing vessels. A vessel hull and a fin keel are attached to a mutually slidable hull connection member and a slidable keel connection member respectively. A tongue-and-groove connection slidably connects the hull and the keel. A compartment contains a spring and is in fluid communication with the surrounding water by means of a conduit. The keel is displaceable backwards if the vessel runs aground or comes into contact with an object below the water line. The keel will be displaced forward to its initial position by means of the compressed spring. The keel is selectively adjustable by means of a wire and tensioning device for purposes of regular maintenance and trimming the vessel by shifting the keel and thus the vessel's center of mass.

24 Claims, 1 Drawing Sheet

SLIDABLE AND IMPACT ABSORBING KEEL

RELATED APPLICATIONS

This application claims the benefit of the Norwegian application 19992516 filed May 26, 1999 and the International application PCT/NO00/00172 filed May 25, 2000.

BACKGROUND OF THE INVENTION

1. Field of the Invention

The present invention is related to impact absorbing devices for marine vessels and more particularly to a slidable, impact absorbing keel device for a sailing vessel.

2. Description of the Related Art

Sailing vessels equipped with a fin keel may frequently run aground, which results in damages to the vessel's keel, hull and internal and external fittings. Such damages are often severe, may present a safety hazard while at sea and subsequently time consuming and costly to repair. The rather abrupt decelerations resulting from the fin keel striking an object or the ground below the water line may also lead to injuries to crew and passengers.

SUMMARY OF THE INVENTION

In order to substantially reduce, and even eliminate, such vessel damages and human injuries, the Inventors have invented the present impact absorbing keel device, which will be described herein.

The invention is an adjustable and impact absorbing keel device for a sailing vessel. This device consists of the keel being slidably attached to the lower hull of the sailing vessel and movable in the hull longitudinal direction and relative to the hull waterline. In addition to its impact absorption features, the slidable keel may also serve as a trimming device, as the keel's longitudinal position, and thus the vessel centre of gravity, may be adjusted by means of a wire and a tensioning device.

BRIEF DESCRIPTION OF THE DRAWINGS

The keel device will now be described with reference to the attached drawings, where the various components have been given unique reference numerals and where.

DETAILED DESCRIPTION OF THE PREFERRED EMBODIMENTS

Figure 1:
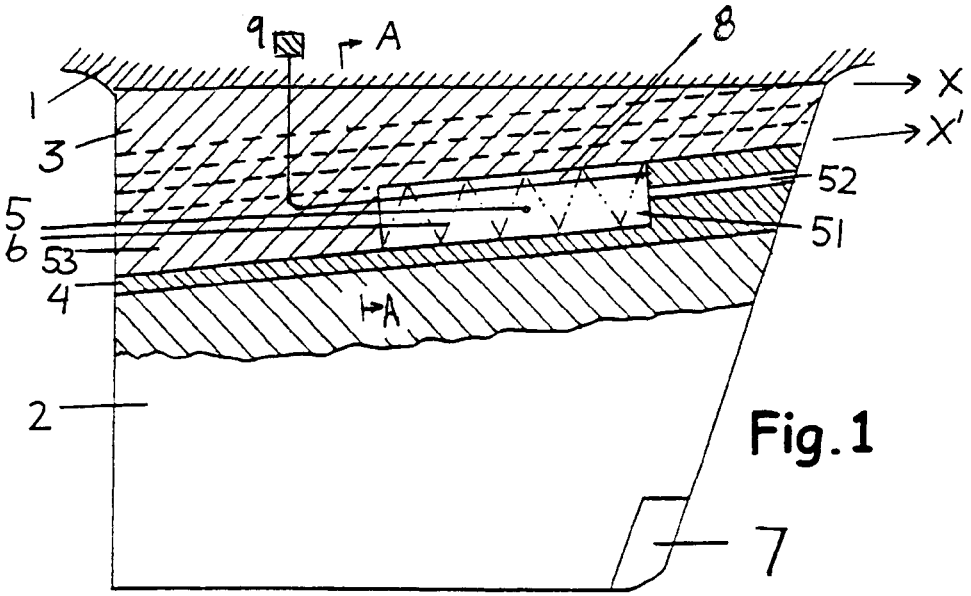
FIG. 1 is a partial sectional drawing along the line B—B of FIG. 3, showing the keel device in its initial and nominal position.
Figure 2:
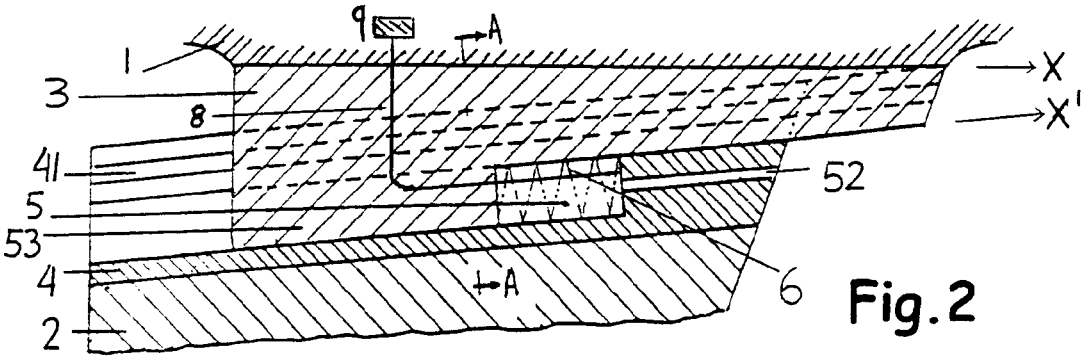
FIG. 2 is a partial sectional drawing along the line B—B of FIG. 3, showing the keel device in a displaced position, following e.g. the sailing vessel running aground or striking an object below the waterline.
Figure 3:
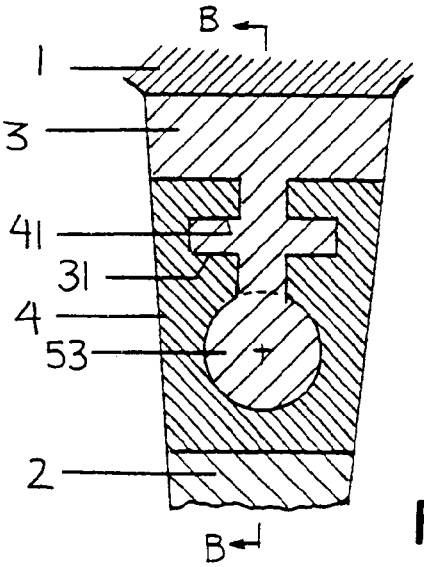
FIG. 3 is a sectional drawing along the line A—A of FIGS. 1 and 2.

FIGS. 1, 2 and 3 show the lower part of a vessel hull (1) attached to a slidable hull connection member (3) and the keel (2) attached to a slidable keel connection member (4). Integrally formed in the slidable connection members (3, 4) is a tongue-and-groove connection (31, 41) which slidably connects the hull and the keel.

There is a, preferably cylindrical, compartment (5) formed within the upper region of the slidable keel connection member (4). A piston head (53), formed in the lower region of the slidable hull connection member (3), defines a rear boundary of the compartment. The compartment is in fluid communication with the surrounding water through a conduit (52), which extends from the forward compartment wall (51) to the keel leading edge. A compression spring (6), preferably a coil spring, is disposed within the compartment (5). Attached to the forward compartment wall (51) is a wire (8) which runs through the length of the compartment, through the slidable hull connection member and into the hull where it is attached (preferably in the vessel cockpit, not shown) to a tensioning device (9).

The keel (2) leading edge is, preferably towards the lower parts, equipped with an impact absorbing pad (7), which absorbs the initial impact and protects the keel structure.

When the sailing vessel is freely afloat, the compartment (5) will be kept filled with water through the conduit (52). The spring (6) will essentially not be compressed. The spring may be selected such that the spring properties are suitable for the weight of the applicable sailing vessel. The conduit may also be sized to suit the vessel in question.

When the keel (2) strikes an object or the ground below the waterline, the resulting impact will force the keel to be displaced towards the rear of the hull (1), along an axis (x') and slightly downwards with respect to the hull nominal waterline (FIG. 2). Some of the initial impact may have been absorbed by the pad (7) at the keel leading edge. The keel will slide by means of the tongue-and-groove connection (31, 41 ) in the slidable hull connection member (3) and the slidable keel connection member (4), respectively.

Such rearward keel motion will diminish the volume of the compartment (5), whereby:

a) The water in the compartment will be forced by the piston head (53) to flow through the conduit (52) and out into the water surrounding the keel, and b) the spring (6) will become increasingly compressed, depending on the magnitude of impact.

Both hydraulic and mechanical impact absorption is thus achieved. The spring properties, as well as the compartment and conduit volumes may be chosen to best suit the applicable sailing vessel.

Some of the kinetic energy generated by the rearward motion of the keel will be stored in the spring (6). The resulting compressive spring force will tend to push towards the forward compartment wall (51) and the piston head (53), thereby moving the keel to its initial position (FIG. 1). If the vessel has run aground, such spring induced keel movement may contribute to bringing the vessel afloat.

The keel is selectively adjustable by means of the wire (8) and tensioning device (9). The slidable keel should as a part of the regular maintenance of the vessel, be moved along the axis (x'), in order to verify that it is functioning properly. The feature of being able to selectively adjust the keel's position along the axis (x'), may also be utilised to trim the vessel, i.e. by shifting the centre of gravity. Upon selectively tightening the tensioning device and thus the wire, the keel is shifted rearward to the selected position and the spring (6) is compressed correspondingly. When the tension in the wire selectively is released by unlocking the tensioning device, the compressive spring force will push towards the forward compartment wall (51) and the piston head (53), thereby moving the keel to its initial position (FIG. 1).

What is claimed is:

1. An impact absorbing keel device for a sailing vessel having a hull, comprising a keel slidably attached to a lower portion of the hull of the sailing vessel and movable in the hull longitudinal direction upon application of a generally rearwardly directed force to a leading or lower edge of the keel and relative to the hull nominal waterline.

2. The device of claim 1, wherein the keel is attached to the hull by means of a tongue-and-groove connection integrally formed in a slidable hull connection member and a slidable keel connection member, respectively, and with the slidable hull and keel connection members being attached to the hull and keel respectively.

3. The device of claim 2, further comprising a compartment formed within an upper region of the slidable keel connection member and a piston head which defines a rear boundary of the compartment formed in a lower region of the slidable hull connection member, wherein the compartment is in fluid communication with the surrounding water by means of a conduit which extends from a forward compartment wall to a leading edge of the keel.

4. The device of claim 3, wherein the compartment holds a compression spring and the compartment has a cylindrical shape.

5. The device of claim 1, wherein a leading edge of the keel is equipped with an impact absorbing pad.

6. The device of claim 2, wherein the slidable connection members are mutually slidable in the hull longitudinal direction and along an axis which lies in a hull nominal vertical plane and is inclined forwardly and upwardly at an angle with respect to the hull nominal water line.

7. The device of claim 4, wherein the keel is displaceable backwards with respect to the hull when a rearward acting force is applied to the keel, and wherein the keel is displaceable forwards when a forward acting force is applied to the keel.

8. The device of claim 7, wherein the forward force is generated by the compression spring, which has been compressed by the rearward force being generated by an impact as the vessel keel is coming into contact with an object or the ground below the water line.

9. The device of claim 2, wherein the keel and the slidable keel connection member are displaceable backwards and downwards with respect to the hull and the slidable hull connection member when subjected to a rearward acting force, and wherein the keel and slidable keel connection member are displaceable forwards and upwards with respect to the hull and the slidable hull connection member when subjected to a forward acting force.

10. The device of claim 1, wherein the keel is selectively adjustable along an axis by means of a wire, a tensioning device, and a compression spring.

11. The device of claim 5, wherein the impact absorbing pad is located at a lower region of the leading edge of the keel.

12. A movable keel system for sailing vessels having a hull, the system comprising:

a keel member having a bottom edge, the keel member being slidably connected to the hull between at least one nominal position and one displaced position; and a damping and energy storage system operably connected to the keel member such that, under an impact of the keel member with an object, the keel member is displaceable backwards so as to minimize damage to the system and vessel and wherein the damping and energy storage system dissipates and stores energy resulting from the impact and displacement of the keel member so as to automatically induce a restoring force to induce the keel member back towards the at least one nominal position.

13. The system of claim 12, wherein the keel member is slidable connected to the hull along an axis that is generally along the longitudinal axis of the vessel and inclined upwards towards the front of the vessel such that the at least one nominal position places the keel member forward and the keel member bottom edge more proximal with respect to the hull than the at least one displaced position.

14. The system of claim 13, wherein grounding of the keel member on the object and subsequent forward movement of the vessel so as to bring the keel member towards the at least one displaced position induces a separating force between the bottom edge of the keel and the hull so as to displace the hull of the vessel from the object.

15. The system of claim 12, wherein the damping and energy storage system employs water surrounding the vessel.

16. The system of claim 12, wherein movement of the keel member from the at least one nominal position to the at least one displaced position induces a reactive force directed towards the front of the vessel so as to slow the vessel and further minimize damage thereto.

17. The system of claim 16, wherein the reactive force comprises a retroactive jet of water.

18. The system of claim 12, further comprising a positioning system operably connected to the keel member such that a user may selectively position the keel member between the at least one nominal position and the at least one displaced position.

19. The system of claim 18, wherein the keel member is selectively positionable by a user to vary the trim and draught of the vessel.

20. A movable keel system for sailing vessels having a hull, the system comprising:

a keel member having a bottom edge, the keel member being slidably connected to the hull; and a positioning system located on the vessel so as to extend away from the keel member and operably connected to the keel member such that a user sailing the vessel may selectively position the keel while sailing the sailing vessel having a hull.

21. The system of claim 20, wherein the keel member is slidable connected to the hull along an axis that is generally along the longitudinal axis of the vessel and inclined upwards towards the front of the vessel.

22. The system of claim 20, further comprising a damping and energy storage system operably connected to the keel member such that, under an impact of the keel member with an object, the keel member is displaceable backwards so as to minimize damage to the system and vessel and wherein the damping and energy storage system dissipates and stores energy resulting from the impact and displacement of the keel member so as to automatically induce a restoring force to induce the keel member back to a nominal position.

23. A movable keel system for sailing vessels having a hull, the system comprising:

a keel member having a bottom edge, the keel member being slidably connected to the hull wherein the keel member is slidable connected to the hull along an axis that is generally along the longitudinal axis of the vessel and inclined upwards towards the front of the vessel; and a positioning system operably connected to the keel member such that a user may selectively position the keel during operation of the sailing vessel having a hull.

24. A movable keel system for sailing vessels having a hull, the system comprising:

a keel member having a bottom edge, the keel member being slidably connected to the hull;

a positioning system operably connected to the keel member such that a user may selectively position the keel during operation of the sailing vessel having a hull; and a damping and energy storage system operably connected to the keel member such that, under an impact of the keel member with an object, the keel member is displaceable backwards so as to minimize damage to the system and vessel and wherein the damping and energy storage system dissipates and stores energy resulting from the impact and displacement of the keel member so as to automatically induce a restoring force to induce the keel member back to a nominal position.

* * * * *